US005253545A

United States Patent [19]

Barrons et al.

[11] Patent Number: 5,253,545

[45] Date of Patent: Oct. 19, 1993

[54] ADJUSTABLE FOOT PEDAL FOR INDUSTRIAL SEWING MACHINES

[75] Inventors: James D. Barrons; Morris D. Hunt, both of Stantonville; Carlton H. Ackermann, Franklin, all of Tenn.

[73] Assignee: DBH Limited, Inc., Adamsville, Tenn.

[21] Appl. No.: 983,819

[22] Filed: Dec. 1, 1992

[51] Int. Cl.[5] ..... G05G 1/14; G05G 1/16

[52] U.S. Cl. ..... 74/561; 74/512; 74/560; 74/562

[58] Field of Search ..... 74/560, 561, 562, 562.5, 74/512, 513; 248/677

[56] References Cited

U.S. PATENT DOCUMENTS

| | | | |
|---|---|---|---|
| 2,279,587 | 4/1942 | Chason | 74/561 |
| 2,834,222 | 5/1958 | Hermanns | 74/561 |
| 3,327,662 | 6/1967 | Abate et al. | 112/217.3 |
| 4,315,473 | 2/1982 | Torre | 112/217.1 |
| 4,870,871 | 10/1989 | Ivan | 74/560 X |
| 4,989,474 | 2/1991 | Cicotte et al. | 74/513 X |
| 5,010,782 | 4/1991 | Asano et al. | 74/560 X |
| 5,067,368 | 11/1991 | Itakura et al. | 112/271 |
| 5,172,606 | 12/1992 | Dzioba et al. | 74/512 |

FOREIGN PATENT DOCUMENTS

| | | | |
|---|---|---|---|
| 215558 | 6/1961 | Austria | 74/560 |
| 861968 | 1/1971 | Canada | 74/562 |
| 962168 | 2/1975 | Canada | 74/560 |

*Primary Examiner*—Vinh T. Luong
*Attorney, Agent, or Firm*—Kalish & Gilster

[57] ABSTRACT

An adjustable foot pedal assembly for control of an industrial machine which is supported by a stand having legs includes a treadle plate rockably mounted on the foot pedal assembly beneath and longitudinal in relation to the stand, for operation of the industrial machine supported by the stand. The foot pedal assembly has a mechanism for selective transverse adjustment of the foot pedal assembly in relation to a longitudinal axis of the stand, connected to the legs of the stand, spacedly in relation to a floor, and a mechanism for selective vertical adjustment of the foot pedal assembly, in relation to the floor, connected to the means for selective transverse adjustment, and a mechanism for selective initial angle of tilt adjustment of the treadle plate.

22 Claims, 4 Drawing Sheets

ADJUSTABLE FOOT PEDAL FOR INDUSTRIAL SEWING MACHINES

BACKGROUND OF THE INVENTION

1. Field of the Invention

The present invention relates generally to the field of machine foot pedals, and, more specifically, to a multi-directionally adjustable foot pedal for attachment to industrial machines, such as sewing machines used in the garment industry.

2. Description of the Prior Art

It is well known in manufacturing industries that workers become fatigued by necessarily maintaining a particular physical position at a work station for long periods of time. The worker's physical position is often necessitated by the nature of the work and the structure of the particular equipment required to accomplish a given task. With increasing fatigue there is of course a decrease in volume of production and an increase in numbers of errors, often leading to serious injury, as well as to production of unacceptable goods.

It is thus desirable that the worker be able to change positions from time to time as needed, and that the equipment used not limit the operator thereof from making such changes. It is especially desired that the individual worker be able to initially set the machine to be used to suit his or her physical needs, for example in regard to overall body size, leg length, etc., so that from the very beginning of the work day the operator's position is as close as possible to ideal for that particular individual, and to be able to rapidly and easily change machine positions during the work shift as needed because of discomfort, alterations in the work per se, or merely due to a shift change and a resultant change in operators for a particular machine. Thus rapid, simple adjustment of the foot pedals position relative to the seated or standing operator in both vertical and transverse positions, as well as with regard to starting angle, is highly desirable.

Heretofore foot pedals for sewing machines for domestic or industrial use have been known which provided some limited adjustability, to differing degrees of satisfaction. In some cases movement of the pedal or treadle is possible only in one direction, such as side to side, and often the adjustment of the pedal is accomplished completely by time-consuming and cumbersome manual methods, sometimes requiring the use of tools and disassembly of the machine. Following are some examples of previously patented pedals for sewing machine operation.

In 1942 U.S. Pat. No. 2,279,587 issued to Chason for a light-weight sheet metal treadle for use with either foot powered or electric sewing machines. The treadle was rockably mounted on a cross bar which is immovably fixed at the base of a sewing machine table, thus completely preventing forward and back, and vertical movement. Moreover, the treadle was attached to the cross bar so as to prevent axial (side to side relative to the operator) movement of the treadle.

A later patent issued to Hermanns (U.S. Pat. No. 2,834,222) for a foot operated sewing machine treadle which provided very limited front to back adjustment of the treadle by manipulation of a screw and slot arrangement situated near the floor, beneath the pedal proper. This step is quite awkward, time-consuming, and may require a significant degree of strength on the part of the operator to release the adjustment screw from its lock washer. Also, no vertical alteration of position is possible with the Hermanns device.

U.S. Pat. No. 3,327,662, which issued to Abate et al discloses foot switch mounting brackets for electric sewing machines which provide only manual, side to side adjustment. U.S. Pat. No. 4,315,473, which issued to Torre teaches a sewing machine bench with paired foot pedals fixed to a support plate which is laterally rotatable and in relation to the operator's seat by manually positioning a screw into one of a series of threaded holes. This pedal device can also be adjusted to and away from the operator on cross-pieces which interconnect the upright supports of the bench at the ends near the floor. However, this forward and back movement is accomplished by manually removing and replacing four screws which connect the support plate to the cross pieces.

Thus there has long been a need for a foot treadle for industrial sewing machines which is adapted for automatic, push button, fine adjustment in multiple directions.

SUMMARY OF THE INVENTION

Accordingly, it is among the objects of the present invention to provide a foot pedal (or treadle) for operation of industrial sewing machines, as well as other industrial machines, which are usually mounted stations and which is quickly, facilely and safely automatically adjustable in a number of directions.

It is another object of the invention that the new foot pedal be capable of adaption for attachment to preexisting machine support stands, as well as being suitable for incorporation into such stands as they are first manufactured.

It is yet another object of the invention that the new foot pedal be extremely sturdy, so as to sustain extended periods of continuous use with need for little or no need for repair.

It is still another object of the present invention that the foot pedal be adapted for rapid, safe push button adjustment even by operators who are relatively unskilled, do not necessarily possess a great deal of strength, and/or are illiterate.

It is a further object of the invention that the new foot pedal be capable of being pneumatically, hydraulically, or electrically powered.

Thus, in keeping with the above objects, the present invention is, briefly, an adjustable foot pedal assembly for control of an industrial machine which is supported by a stand having legs. The adjustable foot pedal assembly includes a treadle plate rockably mounted on the foot pedal assembly beneath and longitudinally in relation to the stand, for operation of the industrial machine supported by the stand. The foot pedal assembly has a mechanism for selective transverse adjustment of the foot pedal assembly in relation to a longitudinal axis of the stand, connected to the legs of the stand, spacedly in relation to the floor, and a mechanism for selective vertical adjustment of the foot pedal assembly, in relation to the floor, connected to the means for selective transverse adjustment, and a mechanism for selective initial angle of tilt adjustment of the treadle plate.

The invention is also, briefly, the above described foot pedal assembly, and which is further adapted for automatically locking the mechanism for selective transverse adjustment, to thereby ensure that a preselected position of the foot treadle assembly, transversly in relation to the longitudinal axis of the stand, is maintained during operation of the machine supported by the stand; as well as being adapted for automatically locking the mechamism for selective initial angle of tilt adjustment, to thereby ensure that a preselected initial angle of tilt of the treadle plate is maintained during operation of the machine.

Other objects and advantages will be in part apparent and in part pointed out hereinbelow.

BRIEF DESCRIPTION OF THE DRAWINGS

Throughout the various figures like parts are indicated by like element numbers.

DESCRIPTION OF THE PREFERRED EMBODIMENT OF THE INVENTION

Figure 1:
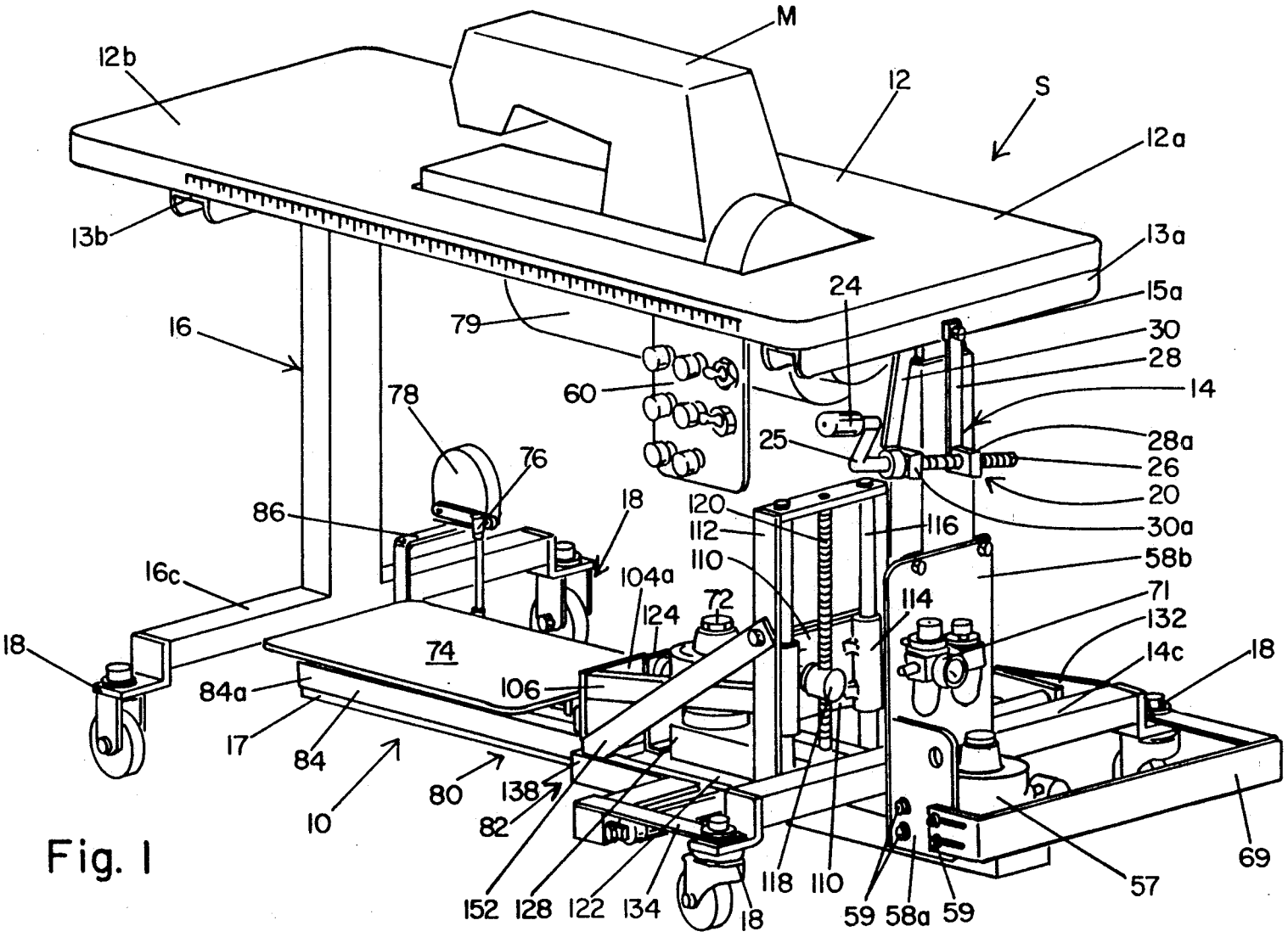
FIG. 1 is a perspective view of an adjustable foot pedal constructed in accordance with and embodying the present invention attached to a support stand having an industrial sewing machine shown schematically thereon, from the front and right of the operator's position.

With reference to the drawings, and specifically with regard to FIG. 1, 10 generally designates an adjustable foot pedal (or foot pedal "assembly"), constructed in accordance with and embodying the present invention, attached at the base of a support stand S for control of a machine M, shown schematically in this figure only, for simplicity, mounted on stand S. Machine M is illustrated for convenience and discussed throughout the specification as an industrial sewing machine. However, it is to be understood and will be made clear from the description that adjustable foot pedal assembly 10 is well suited and capable of use for operation of a wide variety of industrial machines, particularly those which are mounted for use on a support stand.

Although adjustable foot pedal 10 may be connected to virtually any machinery support stand, stand S is preferably of the ergonomic table-type, itself being adjustable to some extent, for the comfort and convenience of the user. A particularly preferred type of ergonomic stand is generally illustrated and claimed in copending U.S. Design Patent Application Ser. No. 07/707,664, filed May 30, 1991, by Barrons et al, the inventors herein. Some modifications have been made to that stand, in the structure of stand S, for purposes of use with foot pedal 10.

As shown in FIG. 1, stand S has a preferably rectangular, flat table top 12 having opposed right and left ends 12*a*, 12*b*, respectively and is adjustably mounted upon right and left leg assemblies 14, 16, respectively, by corresponding elongated U-brackets 13*a*, 13*b* formed of channel iron which are fixed to the underside of table top 12 and extend from front to back thereof so as to open downwardly. For convenience, throughout the specification "front" shall mean the operator's side of stand S, and "back" shall mean the side opposite thereto.

Leg assemblies 14, 16 consist of corresponding telescoping upper extensions 14*a*, 16*a* and lower extensions 14*b*, 16*b* which are each hollow, preferably rectangular in cross section, and sized so that upper extensions 14*a*, 16*a* are slidingly received within corresponding lower extensions 14*b*, 16*b*. The topmost ends of upper extensions 14*a*, 16*a* are received within U-brackets 13*a*, 13*b* where they are penetrated by bolts 15, which also pass through the arms of U-brackets 13*a*, 13*b* for tiltable attachment of table top 12 to leg assemblies 14, 16, as further described hereafter. If desired, more than two leg assemblies may be provided and, regardless of the number, the leg assemblies may be immmovable, or made adjustable by construction other than those specifically described herein.

Lower extensions 14*b*, 16*b* extend upwardly and substantially vertically from the bottom-most ends thereof where rigid, elongated, horizontal members 14*c*, 16*c*, respectively, are fixedly connected. Horizontal members 14*c*, 16*c* may be mounted on rigid feet for substantially immovable contact with the floor F or other support surface, but preferably are mounted as shown on optionally locking caster assemblies 18 for convenient movement of stand S with the attached, usually heavy foot pedal assembly 10 and machine M. Horizontal members 14*c*, 16*c* are firmly connected to each other by a rigid, elongated, open-bottomed housing 17 which is fixed to the horizontal members preferably centrally along the undersurfaces thereof substantially beneath the respective intersections of lower, vertical extension members 14*b*, 16*b*. The function of housing 17 will be discussed in more detail at a later point herein.

Selective tilting of table top 12 is effected by operation of a hand crank assembly 20, seen in FIGS. 1-3 and 7, which assembly 20 is preferably mounted at the user's right, at the top of upper extension 14*a* of leg assembly 14, but which of course could be located at the opposite end of stand S for a special, left-handed machine operator. Hand crank assembly 20 includes an elbow crank 22 having a handle 24 connected to a threaded shaft 26 by elbow portion 25. Handle 24 extends outwardly (forwardly), toward the operator side, and threaded shaft 26 preferably extends transversely in relation to the longitudinal axis of stand S.

Figure 3:
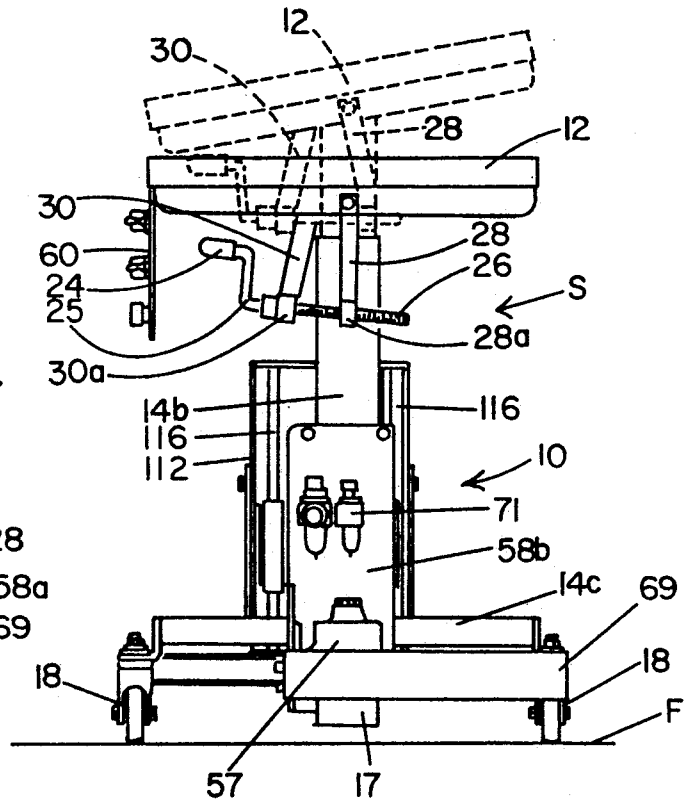
FIG. 3 is right end elevational view of the adjustable foot pedal and support stand of FIG. 1.

As seen in FIG. 3, crank assembly 20 also includes two rigid bars 28, 30 each having fixed at the lowermost ends thereof a boss 28*a*, 30*a*, respectively, for receipt of shaft 26. Boss 28*a* is threaded and sized for rotating passage therethrough of shaft 26. Boss 30*a*, however, merely supportingly and rotatably receives the operator-directed end of shaft 26.

Bar 28 is located rearwardly of bar 30 and is fixed at its upper extreme (for example, by welding) to U-bracket 13*a* on the right outer surface centrally along the length thereof and is penetrated at its uppermost end by bolt 15*a*, which also completely penetrates upper extension 14*a* and the associated U-bracket 13*a*, and is snugly fitted to avoid wobble and wear of contact parts. Bar 30 is preferably immovably fixed (for example, by welding) at its uppermost end to the front of the top of upper leg extension 14*a* and angles downwardly and forwardly to support elbow 25 which passes rotatably through boss 30*a*. With crank assembly 20 so mounted, rotation of handle 25 necessarily causes rotation of shaft 26 and the resultant movement of boss 28*a* thereon in turn causes movement of the attached rigid bar 28 longitudinally, toward or away from the axis of bar 30, and substantially simultaneous tilting upwardly and forwardly, or downwardly and rearwardly f table top 12, depending of course upon the direction of rotation of handle 25 and the thread of shaft 26. This feature is illustrated in FIG. 3, wherein tabletop 12 is shown in an upwardly and forwardly tilted position, in phantom, and in the flat, horizontal position in solid lines.

The described hand crank assembly 20 permits tilting of table top 12 while still maintaining a very firm, secure connection of the attached right end 12*a* of table top 12. However, in order to avoid inherent instability or "wobble" at end 12*b*, which is to be expected particularly if the table top has a cutout area for receiving the supported machine, it is necessary to provide further securement of table top 12. This is expecially necessary when heavy machinery (such as a sewing machine) with moving parts which cause vibrations and resultant stresses is used on the support stand. Accordingly, a releasable locking device, such as a hand lock mechanism 32, is preferably mounted at end 12*b* of the table top, as shown most clearly in FIG. 5.

Hand lock 32 consists in part of a short rigid bar 34 which is connected at one end thereof to bolt 15*b* (not seen here) which penetrates U-bracket 13*b* so as to extend generally downwardly, and at an angle away from the user. A slotted, short rigid bar 36 is pivotally fixed at one of its ends to U-bracket 13*b*, rearwardly of bolt 15*b*, by a similar bolt 37 so as to hang substantially vertically downwardly when table top 12 is in a fully down, horizontal mode. The lower end of bar 34 is positioned next to slotted bar 36 and is slidably connected thereto by a thumbscrew 38 which penetrates and is longitudinally movable in slotted bar 36.

Thus, when it is desired to reposition the angle of table top 12, thumb screw 38 is quickly, manually released, hand crank assembly 20 is operated as described, causing tilting of table top 12 and corresponding movement of the attached slotted bar 36, in turn causing movement of rigid bar 34. Thumbscrew 38 is then tightened, thereby firmly securing table top end 12*b* in the new flat or angled position.

Table top 12, whether positioned flat or tilted, can preferably also be raised and lowered in relation to floor F for selective use of the machine M in either seated or standing position, as the operator chooses. This is desirably, although not necessarily, accomplished by a mechanical screw and chain drive assembly which may be controlled either automatically, such as by the pneumatic system shown and described hereafter (or by an hydraulic or electric alternative), or manually, for example, by operation of a crank (not shown) similar to crank 24.

Figure 2:
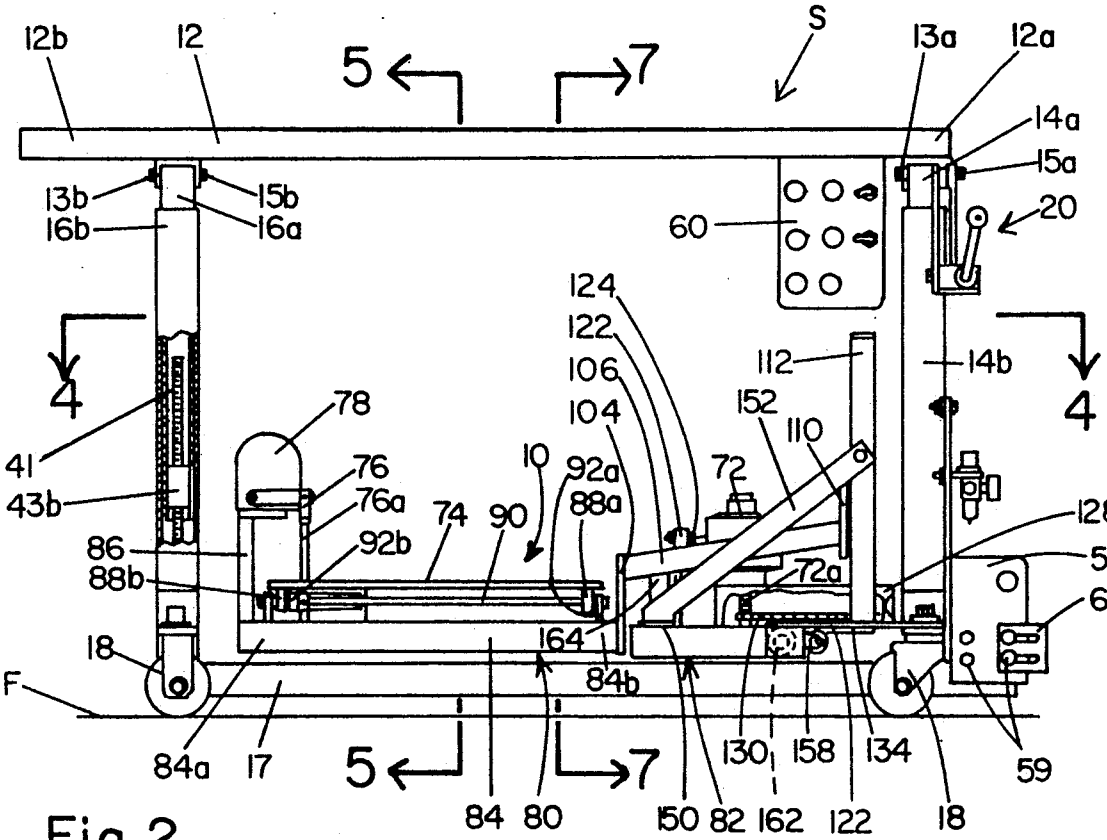
FIG. 2 is a front elevational view of the adjustable foot pedal and support stand of FIG. 1.
Figure 4:
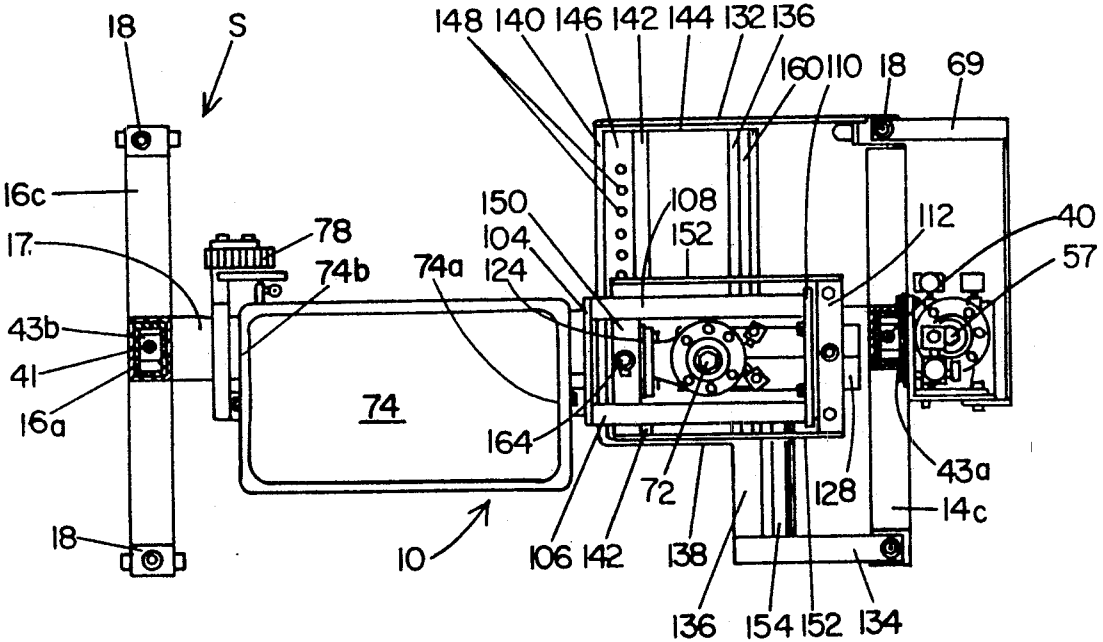
FIG. 4 is a horizontal sectional view, taken on line 4—4 of FIG. 2.
Figure 6:
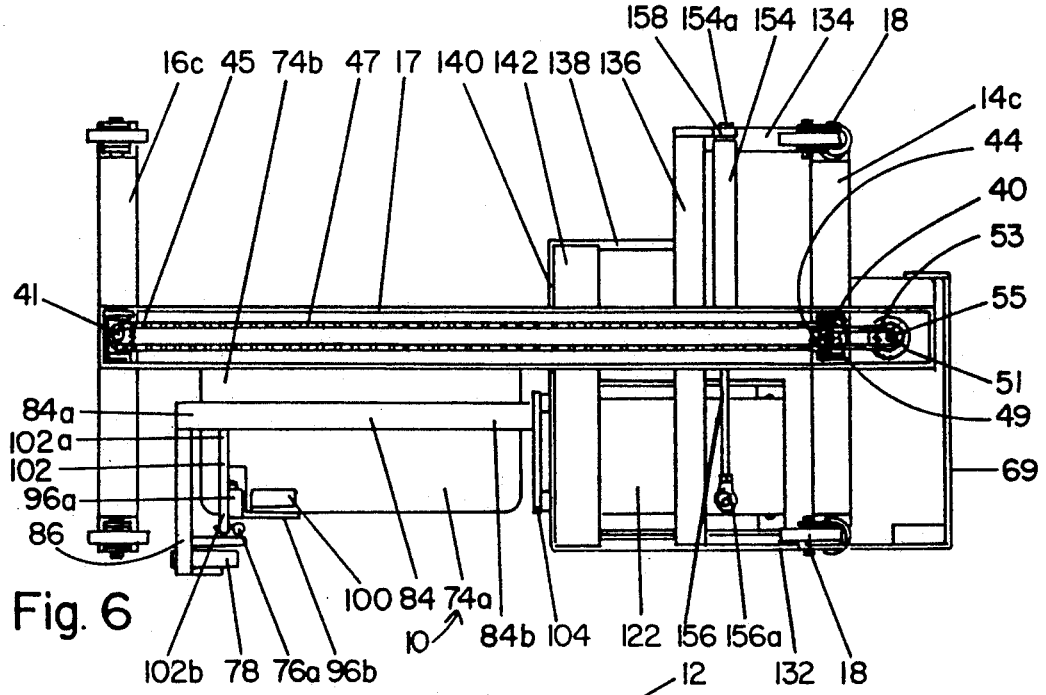
FIG. 6 is a bottom plan view of the foot pedal and support FIG. 1.
Figure 7:
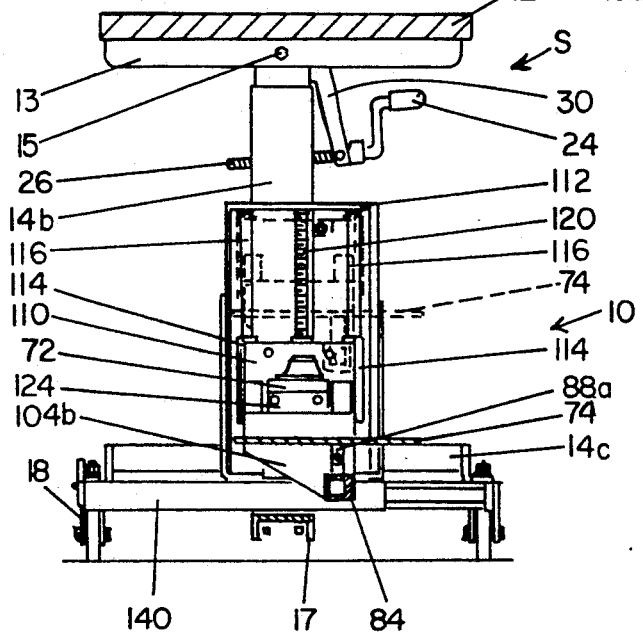
FIG. 7 is a vertical sectional view taken on line 7—7 of FIG. 2.

FIGS. 2, 4, and 6 show threaded rods 40, 41 which are housed rotably, centrally and longitudinally within upper leg extensions 14*a*, 16*a*, respectively, and maintained in vertical position inwardly from the extension walls by rigid threaded spacers 43*a*, 43*b*, respectively through which rods 40, 41 rotatably pass, and which are internal relative to upper extensions 14*a*, 16*a*. As is seen most clearly in FIG. 6, threaded rods 40, 41 extend at the lowermost ends thereof, outwardly beneath corresponding lower leg extensions 14*b*, 16*b* and have transversely connected thereto toothed gears (sprockets) 44, 45, respectively. Gears 44, 45 are moveably interconnected by a continuous chain 47, such as a bicycle chain, from which the operator of machine M is protected by virtue of chain 47 being covered by housing 17, previously described.

Threaded rod 40 extends downwardly, beyond gear 44 where there is mounted at the lower-most end yet another such toothed gear 49 which has mounted thereon, in the usual manner a substantially shorter continuous chain 51. Chain 51 in turn extends to the user's right where it interconnects a further sprocket 53. Sprocket 53 is similarly rigidly and transversely mounted at the lowermost end of a shaft 55 which extends rotatably downward from a small, commercially available air motor 57 which is secured adjacent to leg assembly 14 on the right side thereof, as described below.

As seen in FIG. 1, motor 57 is attached to a rigid L-shaped mounting plate 58 with preferably at least four bolts 59 to the short wall 58*a* thereof. The long, or large wall 58*b* of motor mounting plate 58 is secured to horizontal support 14*c* and/or lower leg extension 14*b* of stand S, for example, preferably by bolting or welding thereto, and provides a site for connecting pneumatic valve and/or meter devices, for example as shown at 71, for attachment and monitoring of a main air intake line (not shown) from an independent air source. Extra nut and bolt assemblies (or some other fasting devices) may be provided on wall 58*b* for optional connection of accessories as needed, and apertures may be formed through wall 58*a* for passage therethrough and support of one or more air lines. The air lines used in this preferred embodiment of the invention and mentioned throughout the specification are well known and thus for simplicity and clarity are not discussed in detail, nor shown.

Because, in the preferred embodiment shown, air motor 57 extends outwardly from the main body of stand S, and thus is likely to be bumped against other objects if the stand is moved, or kicked by individuals moving about the workplace, it is protected by a rigid U-shaped metal shield 69, which is preferably painted a bright color, to attract the eye, and which adjustably attaches by bolts 59 at one slotted end to motor mount plate 58*a*, and at the other end to the upper end of a wheel assembly 18 at the rear of horizontal support member 14*c*. In this manner, motor 57 can be easily accessed for service or replacement by simply removing or loosening bolts 59. Of course, other adequate locations for motor 57 and methods of attachment are conceived.

Figure 8:
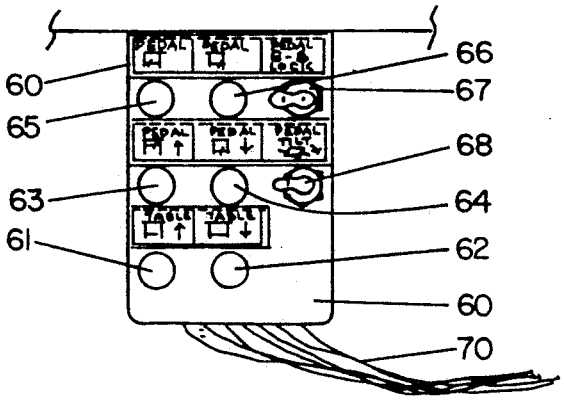
FIG. 8 is an enlarged detailed view of the control panel for the foot pedal of FIG. 1.

Operation of motor 57 is effected via the preferred control panel 60 shown enlarged in FIG. 8 and having a number of buttons or switches (for example 61–68) and simple schematic associated directions for effecting movement of stand S and adjustment of foot pedal assembly 10, as further described hereafter. To initiate raising of table top 12 to a higher position, such as that shown in phantom in FIG. 3, the operator merely touches and holds button 61 until the desired height is reached. Lowering of table top 12 is likewise effected by touching and holding button 62.

The described operation of buttons 61, 62 activates air motor 57 by way of the usual pneumatic lines 70 (shown schematically only, in FIG. 8). Thereafter, as is clear from FIGS. 2 and 6, operation of air motor 57 causes rotation of motor shaft 55 and sprocket 53 which is connected thereto. Turning of sprocket 53 causes movement of chain 51, which in turn effects movement of gear 49 and shaft 40 upon which it is fixed. Likewise, rotation of shaft 40 results in rotation of the attached toothed gear 44, thereby causing movement of chain 47 which is transferred to gear 45 and threaded shaft 41.

As all such rotational movement occurs substantially simultaneously, upper leg extensions 14*a*, 16*a* necessarily move longitudinally together up or down, within their corresponding lower extensions, as shafts 41, 44 move rotatably through threaded spacers 43, and thus carry table top 12 evenly and smoothly up and down, as signaled by the operator of machine M.

A second small air motor 72 is mounted inwardly of leg extension 14 and is operated in similar push button fashion, all as further described hereafter, for effecting smooth vertical movement of foot pedal assembly 10 and securement in preselected vertical positions.

Foot pedal assembly 10 includes a large, rectangular foot or treadle plate 74 which is quite strong and durable, being formed preferably of heavy gauge steel and is preferably painted to deter rusting. Treadle plate 74 is quite wide, for example, approximately 16 inches long, thus providing ample room for placement of both of the operator's feet, if being used while seated, and permitting the operator to move his or her feet side to side as desired, or necessary, while still maintaining adequate contact with treadle plate 74 to operate machine M. Thus, mechanical provisions for side to side adjustment f treadle plate 74 are not necessary, and the lack thereof simplifies the provision of adjustability of treadle plate 74 in the three independent directions, forward and back (transversely of the longitudinal axis of stand S), vertically, and the initial angle of tilt.

For operation of machine M, plate 74 is moveably connected by hinged levers 76 to a commercially available speed control box 78 which in turn connects by a length of electrical cord (not shown) to motor 79 for controlling machine M. Motor 79 is shown only in FIG. 1, for simiplicity and clarity of the drawings. Because leg assemblies 14, 16 can vary greatly in length, it is preferred, and sometimes required, to have such an elongated, flexible connection of speed control box 78 to motor 79. A rigid mechanical connection thereof would at times require changing or removing certain parts to accomodate large changes in overall height of stand S.

Treadle plate 74 and speed control box 78 are each mounted on a structure which will be generally referred to as a vertical carriage 80, for simultaneous, cooperating movement of one with the other, as well as with air motor 72, as the vertical position of plate 74 is adjusted by the operator of machine M. A transverse carriage, generally designated 82 interconnects with vertical carriage 80 in such manner, as described more fully hereafter, so as to permit simultaneous forward and back movement of treadle plate 74, air motor 72 and speed control box 78, in relation to the longitudinal axis of stand S, regardless of the height thereof. Thus, as is clear from the drawings and the description which follows the height adjustment features and the transverse adjustment features of assembly 10 operate independently of one another.

Transverse carriage 82 includes a heavy, rigid bar 84 suspended, as will be further described, parallel to and moveable within a plane substantially adjacent to the upper surface of elongated housing 17, so as to extend lengthwise in relation to table top 12. Bar 84 extends straight and continuously between opposed left and right ends 84*a*, 84*b* thereof, respectively. Fixed at left end 84*a* is an L-bracket 86 upon which speed control box 78 is removeably fixed, for example by bolts 77, for secure yet interchangeable positioning.

Treadle plate 74 is preferably rectangular, having parallel short sides 74*a*, 74*b* positioned to the right and left, respectively, of the operator, perpendicular to the longitudinal axis of stands. Fixed to the underside of plate 74, midway along each end 74*a*, 74*b*, and in alignment with each other are depending brackets 88*a*, 88*b*, respectively. Brackets 88*a*, 88*b* each define an aperture (not seen) for pivotal passage therethrough of a treadle shaft 90 upon which treadle plate 74 is rockably mounted. Similar brackets 92*a*, 92*b* extend upwardly from and are fixed to corresponding ends 84*a*, 84*b* of longitudinal bar 84. Brackets 92*a*, 92*b* are preferably positioned outwardly of brackets 88*a*, 88*b* and serve to rotatably journal the opposed ends of pivot bar 90.

Hinged levers 76 of speed control box 78 include a substantially vertical arm 76*a*, the lower end thereof which is received in a boss 4 which is fixed to the undersurface of the back end of edge 74*b* of treadle plate 74, to thereby actuate speed control box 78 through foot-powered rocking movement of the treadle plate. Clearly, although preferred, this location and arrangement of the speed control mechanism in relation to foot treadle plate 74 may be varied as necessitated by the structure of the particular machine support stand to which foot pedal assembly 10 is connected.

Because of the various requirements of different machine operators, it may be desired to change the initial angle of tilt of treadle plate 74. For example, one person may prefer to work seated at stand S with knees and thighs well under table top 12. In this position, it may be most comfortable to have plate 74 positioned substantially horizontally in relation to floor F (as in FIG. 1). Another individual, perhaps with longer limbs, may prefer to work seated at a greater distance from machine M. In this case it may be more comfortable to have plate 74 set at a downward and forward angle relative to the plane of the floor, as shown in phantom in FIG. 5.

Figure 5:
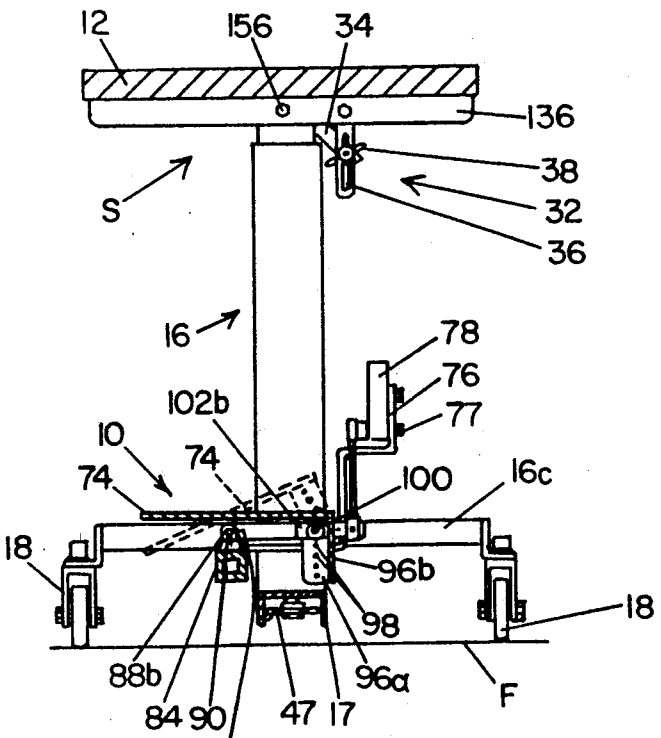
FIG. 5 is a vertical sectional view taken on line 5—5 of FIG. 2.

To accomodate the above needs the new foot pedal assembly 10 has been provided with a mechanism for quick adjustment and automatic (preferrably pneumatically powered), push button locking and unlocking, which is illustrated most clearly in FIGS. 5 and 6. A rigid L-bracket 96 is fixed to the underside of treadle plate 74, preferably forwardly along left edge 74*a*, in such manner that the rectangular, perpendicular flanges 96*a*, 96*b* which form the arms thereof depend vertically toward floor F when plate 74 is positioned horizontally. Flange 96*a* is thick, relative to flange 96*b* and is parallel to edge 74*a*, and extends toward the left end of pivot bar 90.

Along the length of flange 96*a* an arced series of evenly spaced apertures 98 are formed for selective receipt of a cylinder pin (not shown) which projects from a cylinder 100 for firing therefrom. Cylinder 100 is mounted at the end of one arm of an elongated forked member 102, which is pivotally mounted at the singular end 102*a* thereof to treadle shaft 90 and extends outwardly to clasp flange 96*a* at the forked end. Cylinder 100 is mounted at the rearwardly extending 102*b* forked end of member 102, perpendicularly thereto and parallel to the back edge of treadle plate 74.

Cylinder 100 is attached by air lines (not shown) so as to be pneumatically operated by manipulation of switch 68 on control panel 60. Switch 68 permits selective locking and unlocking of cylinder 100 from a co-aligned aperture 98. When unlocked, treadle 74 can be freely pivoted by foot pressure, and when in the desired position, switch 68 is operated to activate pneumatic firing of a pin (not seen) from cylinder 100 to engage one of apertures 98 and thereby maintain treadle plate 74 in a preselected initial tilt position. Unlocking of cylinder 100 to release plate 74 is managed by moving switch 68 in the opposite direction, i.e. opening or closing an air valve (depending upon the arrangement chosen) thereby affecting the direction air flow and releasing engagement of the cylinder pin.

Vertical adjustment, both up and down, of treadle plate 74 is also automatically accomplished, preferably by pneumantic control of a chain drive mechanism, to be described, which is connected to vertical carriage 80 and discussed hereafter with reference to FIGS. 1, 2, 4 and 7.

A rigid plate 104 is preferably formed as a right triangle, for economy of manufacture, but may be rectangular if desired, and is positioned vertically and transversely in relation to the longitudinal axis of stand S in such manner that one of the edges of the right angle faces forwardly and vertically and the other of the edges of the right angle is positioned horizontally and transversely and extends rearwardly from the upper end of the vertical front edge. So positioned, the planar surfaces 104*a*, 104*b* of plate 104 face to the right and left, respectively. Rigid longitudinal bar 84 (previously discussed) is perpendicularly fixed, preferably by welding, at right end 84*b* substantially adjacent to the bottom of the vertical front edge of plate 104.

As seen in FIGS. 2 and 4, two rigid bars 106, 108 are fixed at corresponding left ends thereof to the front and back upper corners of surface 104*b* of rigid plate 104 and extend parallel to one another, at an angle gradually upwardly to the operator's right until intersecting a rectangular carriage plate 110.

FIG. 1 illustrates that carriage plate 110 is generally positioned in a vertical plane parallel to the plane of plate 104 and is mounted in a rigid rectangular frame 112 positioned substantially vertically and transversely, relative to the length of stand S above housing 17. On the right hand surface of carriage plate 110, along each vertical edge thereof, and parallel to each other are fixed rigid tubular vertical guides 114 each provided with a smooth central bore which slidingly receives one each of a pair of smooth vertical shafts, or "slides" 116, fixed inwardly of and parallel to the long vertical edges of rigid rectangular frame 112. Fixed centrally on the right hand surface of carriage plate 110 is a boss 118 having a threaded bore for rotatable passage therethrough of a correspondingly threaded shaft 120 which is vertically and centrally fixed longitudinally within frame 112.

The bottom of vertical frame 112 is fixed, for example by bolting or welding to a flat, horizontally positioned motor mount plate 122 which extends from the base of frame 112 continuously toward the user's left, and terminates prior to intersecting vertical plate 104 so as to be positioned perpendicular and spacedly in relation thereto. To the left end of mount plate 122 there is vertically fixed a heavy bracket 124, preferably formed of angle iron, and to which air motor 72 is removably but securely connected, for example by bolts 126.

Spaced inwardly on horizontal motor mount plate 122, to the right of bracket 124, an elongated box-shaped housing 128 is attached longitudinally, and is shown partially broken away in FIG. 2. Air motor 72 is positioned above the left end of housing 128 and the threaded shaft 72*a* of motor 72 extends vertically, downwardly into housing 128 to engage a continuous chain 130, preferably in a manner similar to that previously described with respect to operation of chains 47 and 51. Chain 130 is completely enclosed within housing 128, for safety, and extends to the user's right where it moveably engages the lower end of threaded shaft 120, which rotatably penetrates the upper surface of housing 128.

With vertical carriage 80 so constructed, vertical adjustment of treadle plate 74 can be quickly and facilely effected by pressing buttons 63 and 64 on control plate 60, thus opening and closing conventional air valves (not seen) to pneumatically control air motor 72. Rotation of motor shaft 72*a* causes horizontal motion of chain 130 mouned thereon, which motion is transferred to vertical threaded shaft 120 within frame 112, resulting in smooth, finely controlled sliding movement of carriage plate 110 upon vertical slides 116.

This vertical movement is consistent throughout the entire vertical carriage structure 80, just described, and effects simultaneous carriage of both treadle plate 74 and the described speed control mechanism attached thereto. Once the appropriate button 63, 64 is released, the associated air valve closes, stopping the flow of air and the resultant movements of chain 130 and carriage plate 110. Thus, usually, no locking device is considered necessary for vertical carriage 80.

Forward and backward sliding movement of foot pedal assembly 10 is also accomplished automatically and preferably pneumatically upon carriage assembly 82, which is illustrated most clearly in FIGS. 1, 2, 4 and 6.

Horizontal carriage assembly 82 (to be described in detail hereafter) is mounted for transverse movement on a, rigid horizontal frame formed of various metal slats and bars interconnected as described below. The frame includes as one transverse side, at the user's right, rigid horizontal leg support member 14*c*. Extending longitudinally, to the left, in a plane perpendicular to horizontal leg support member 14*c* is a rigid bar 132 which is fixedly attached thereto A shorter rigid bar 134 is preferably detachably connected at a right end thereof to the forward end of horizontal leg support member 14*c*, preferably at the mounting point for the corresponding caster assembly, and extends longitudinally, substantially parallel to bar 132 until intersecting and being fixedly connected at its left end perpendicularly to the forward end of a rigid extension slat 136 which extends horizontally, and transversely in relation to the axis of stand S, and parallel to support member 14*c*, passing in a horizontal plane above housing 17 and continuing until intersecting and being fixed to rigid longitudinal bar 132. This elongated slat 136 also forms part of the supporting rigid, horizontal frame of transverse carriage assembly 82, lending strength thereto.

Intersecting perpendicularly to the left of slat 136 and rigidly fixed, spaced rearwardly of the forward end thereof, is another rigid bar 138 which continues longitudinally leftward until intersecting at a right angle and being fixed to a forward end of still another rigid bar 140, which in turn passes transversely above housing 17 until intersecting and being fixed to the left end of longitudinal rigid bar 132, thus completing the outline of a very strong, rigid frame which acts as a horizontal base for transverse carriage 82.

For extra support it is preferred to provide another horizontal, transverse slat 142 fixed to the left ends of longitudinal bars 132, 138, and perpendicularly thereto, within the same plane as slat 136. Slat 142 extends forwardly until intersecting the left end of rigid short bar 138 to which it is perpendicularly fixed.

Reinforcement of the rearmost wall of the frame is provided by a flat bar 144 which intersects and is fixed to the rearward ends of slats 136, 142. Also connected to the left end of flat bar 144 is slat 146 which is penetrated centrally, along the longitudinal axis with spaced apart apertures 148. Slat 146 extends forwardly, adjacently above and parallel to support slat 142, until intersecting and being fixed to the left end of longitudinal, rigid short bar 138, which thus forms the front wall for the above-described horizontal frame.

FIGS. 2 and 4 illustrate that a metal strip 150 is attached flush and parallel to the left end of motor mount plate 122 and extends beyond the front and back edges thereof. Paired, parallel metal slats 152 are fixed, one each, at the left ends thereof to the opposed ends of metal strip 150, and extend diagonally and upwardly to the user's right until intersecting and connecting the vertical sides of vertical frame 112, outwardly thereof, in such manner so as to not interfere with the travel of vertical carriage plate 110 within frame 112. Thus, vertical carriage 80 and transverse carriage 82 are interconnected as described to permit adjustment of either one without altering the preselected position of the other, and also not affecting the initial tilt angle previously discussed.

FIGS. 1, 2, 4 and 6 illustrate the mechanism which makes possible the transverse movement of treadle plate 74 as connected to transverse carriage 82. This mechanism includes a pneumatic cylinder 154 which is powered by an air supply which is connected thereto in the usual manner. Pneumatic cylinder 154 includes a cylinder rod 156. The outer end **156*a* of rod 156 is bolted to the underside of motor mount plate 122 and the opposed end 154*a* of cylinder 154 is spacedly connected, preferably by a bracket 158 to the forward end of transverse extension slat 136 so that cylinder 154 is parallel and adjacent to slat 136, beneath motor mount plate 122 and passes transversely above housing 17**.

A longitudinal, rigid tube-like collar 162 is fixed to the bottom of motor mount plate 122, transversely in relation to the longitudinal axis of stand S, and parallel a and adjacent to pneumatic cylinder 154. Collar 162 serves to receive a rod-like transverse slide 160 which supports and guides the transverse movement of adjustable foot pedal assembly 10. As seen in FIG. 4, slide 160 is parallel to transverse slat 136 and spacedly adjacent above it.

Activation of pneumatic cylinder 154 is effected by pressing a button, such as those shown and indicated as 65, 66 on control plate 60 (FIG. 8), to cause an air valve (not shown) to open or close and thereby permit air flow through the usual lines to move rod 156 in or out of the associated cylinder 154, as the case may be. Movement of rod 156 is necessarily accompanied by corresponding movement of motor mount plate 122 which is connected to piston end **156*a* on transverse slide 160**.

In order to maintain the preselected transverse position of treadle plate 74, a small air cylinder 164 is mounted vertically on metal strip 150. As seen in FIG. 4, as transverse carriage 82 moves forwardly and backwardly in relation to the operator, strip 150 passes over strip 146 and the spaced apertures 148 therein. Cylinder 164 is positioned on strip 150 so as to be in vertical alignment with an imaginary line connecting the series of holes 148. Thus when the desired transverse position is acquired a pin (not seen) may be pneumatically fired from cylinder 164 through an aperture (not seen) in strip 150 to engage a hole 148 directly beneath the vertically positioned air cylinder 164. Firing of the locking pin from cylinder 164 is powered by air motor 72 and is effected by manipulating switch 67 on control plate 60 to open or close an air valve in the usual fashion to control the flow of air through conventional air lines to extend the cylinder pin to engage a hole. Disengagement of the pin from the associated hole 148 is similarly effected by moving switch 67 in the opposite direction.

Clearly, a great number of variations may be made in the structure of the above-described preferred embodiment without impairing the function thereof. In some cases these variations may be required in order to attach adjustable foot pedal 10 to a particular machine stand. Thus some alteration in connections and shapes of the various parts is expected. Also, although it is preferred that all parts be formed of high quality, heavy guage steel, it is understood that other materials may function adequately also. In some cases a thinner and/or lighter material may be used, although such may not be as durable as would be liked.

Similarly, any of a number of button/switch arrangements and pictoral or written instructions therefor may be provided on control panel 60. Also, adjustable foot pedal assembly 10 may be attached to a machine stand which does not have an adjustable top or extendible legs. Conceivably, any of the three described adjustment features may be provided individually and used alone, if desired, for example to supplement other, preexisting adjustment features on a prebuilt machine control apparatus. However, it is intended that all three (vertical, transverse and intial angle of treadle plate tilt) be provided and used together.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. The combination of an adjustable foot pedal assembly and an industrial machine which is supported by a stand having legs in contact with a support surface; said foot pedal assembly comprising a treadle plate rockably mounted on said foot pedal assembly beneath and longitudinally in relation to the stand, for operation of the industrial machine supported by the stand;

means for selective transverse adjustment of said foot pedal assembly in relation to a longitudinal axis of the stand, connected to the legs of the stand, spacedly in relation to the support surface, to thereby permit placement of said treadle plate at a position an optimal distance from an operator of said industrial machine;

means for selective vertical adjustment of said foot pedal assembly, in relation to the support surface, connected to the means for selective transverse adjustment, to thereby permit placement of said treadle plate at a position an optimal height from the support surface for the operator of the machine;

means for selective initial angle of tilt adjustment of said treadle plate;

whereby the height, transverse position and initial angle of tilt of said treadle plate can each be adjusted independently of and irregardless of one another.

2. The combination of claim 1, and further comprising a control panel connected to each of said means for selective adjustment, to thereby permit automatic operation of said adjustable foot pedal assembly.

3. The combination of claim 1, and further comprising at least one air motor connected to said means for selective vertical adjustment to thereby effect smooth vertical movement of said foot pedal assembly and securement thereof in a preselected vertical position.

4. The combination of claim 1, and further comprising means for automatically locking said means for selective transverse adjustment, to thereby ensure that a preselected position of said foot pedal assembly, transversely in relation to the longitudinal axis of the stand, is maintained during operation of the machine supported by the stand.

5. The combination of claim 1, and further comprising means for automatically locking said means for selective initial angle of tilt adjustment, to thereby ensure that a preselected initial angle of tilt of said treadle plate is maintained during operation of the machine.

6. The combination of claim 1, and further comprising a speed control box mechanically connected to said treadle plate and electrically connected to a motor of the machine whereby an operator of the machine can control the speed thereof by depressing or releasing the treadle plate of said foot pedal assembly.

7. The combination of claim 1, wherein said means for selective vertical adjustment comprises a chain drive mechanism.

8. The foot pedal assembly of claim 7, wherein said chain drive mechanism includes a bar upon which said treadle plate is longitudinally and pivotally mounted beneath the stand, a rigid, rectangular frame connected to the bar upon which said treadle plate is mounted, vertical slides which are spaced apart and parallel in relation to each other, and fixed within said rigid, rectangular frame, a threaded shaft having first and second ends and extending therebetween, vertically, rotatably mounted within said rigid rectangular frame, the first end of said threaded shaft being connected to said rigid rectangular frame, and the second end of said threaded shaft having a toothed gear mounted thereon, a rectangular carriage plate vertically moveably attached to said vertical slides and to said threaded shaft within said vertical frame, and rigidly fixed perpendicularly to said bar upon which said treadle plate is longitudinally and pivotally mounted, an elongated housing connected longitudinally to said foot pedal assembly between said foot treadle and said rigid, rectangular frame and having first and second opposed ends, the first end extending into said rigid, rectangular frame at a base thereof and being penetrated by said threaded shaft, the toothed gear mounted on said threaded shaft being completely enclosed within said housing, a continuous chain enclosed entirely within said housing and mounted on the toothed gear of the threaded shaft, a motor positioned at the second end of said elongated housing, said motor having a rotatable motor shaft which penetrates said housing and is attached to said continuous chain, whereby operation of said motor causes rotation of said threaded shaft, resulting in vertical movement of said carriage plate and said bar rigidly fixed thereto.

9. The combination of claim 1, wherein said means for selective transverse adjustment of said foot pedal assembly comprises a slide mechanism.

10. The combination of claim 9, wherein said slide mechanism comprises a rigid horizontal frame beneath the stand, a slide rod secured within the horizontal frame, spacedly and parallel in relation to the floor, and transversely in relation to the longitudinal axis of the stand, a rigid, flat plate positioned horizontally within the rigid horizontal frame and having a rigid tube fixed to an undersurface thereof, the rigid tube having a bore sized for slidable receipt therein of said slide rod, said rigid, flat plate being connected to said treadle plate for simultaneous movement of said treadle plate as said rigid, flat plate moves transversely in relation to the longitudinal axis of the stand on said slide rod, and means for effecting transverse movement of said rigid, flat plate operatively connected thereto.

11. The combination of claim 10, wherein said means for effecting transverse movement of said rigid flat plate comprises a first pneumatic cylinder having first and second opposed ends, said first end being connected to said rigid, horizontal frame, and said second end being connected to said rigid, flat plate on the underside thereof, parallel to said slide rod, so that actuation of said first pneumatic cylinder causes corresponding movement of said rigid, flat plate, an air supply for providing power to said first pneumatic cylinder, and means for automatically operating said air supply to thereby cause selective transverse adjustment of said foot pedal assembly.

12. The combination of claim 10, and further comprising means for automatically locking said slide mechanism to thereby ensure that a preselected transverse position of said foot pedal assembly is maintained during operation of the machine.

13. The combination of claim 12, wherein said means for automatically locking said slide mechanism is pneumatically controlled.

14. The combination of claim 13, wherein said pneumatically controlled means for automatically locking said slide mechanism comprises a rigid bar having a series of spaced apart apertures formed therein, said rigid bar being fixed transversely within said rigid horizontal frame, parallel to said slide rod, and a second pneumatic cylinder vertically attached to an upper surface of said rigid, flat plate, said rigid flat plate defining an aperture therein in alignment with which said second pneumatic cylinder is attached and through which a rod within said second pneumatic cylinder can be selectively projected, the aperture in said rigid flat plate passing consecutively over the series of spaced apart apertures formed in said rigid bar, to cause said second pneumatic cylinder to engage a particular one of said series of spaced apart apertures when selective transverse adjustment of said foot pedal assembly is complete, said second pneumatic cylinder also being disengageable to unlock said pneumatic slide mechanism when it is desired to transversely readjust said foot pedal assembly.

15. The adjustable combination of claim 1, wherein said means for selective initial angle of tilt adjustment of said treadle plate rockably mounted on said foot pedal assembly comprises a flange fixed transversely and perpendicularly to a bottom surface of said treadle plate and having an arced series of spaced apart apertures formed therein, a fluid cylinder fixed longitudinally to the underside of said treadle plate perpendicularly in relation to said flange, and spacedly from and directed toward said arced series of spaced apart apertures, and means for selectively activating said fluid cylinder when said treadle plate has been adjusted by pressure from a foot to a preselected initial angle of tilt position, to thereby cause said fluid cylinder to engage a coaligned one of said spaced apart apertures, locking said foot treadle in the preselected position.

16. The combination of an adjustable foot pedal assembly and an industrial machine which is supported by a stand having legs in contact with a support surface; said foot pedal assembly comprising a treadle plate rockably mounted on said foot pedal assembly beneath and longitudinally in relation to the stand, for operation of the industrial machine supported by the stand;

means for selective transverse adjustment of said foot pedal assembly in relation to a longitudinal axis of the stand, connected to the legs of the stand, spacedly in relation to the support surface;

means for selective initial angle of tilt adjustment of said treadle plate; and means for selective vertical adjustment of said foot pedal assembly, in relation to the support surface, connected to the means for selective transverse adjustment, wherein said means for selective vertical adjustment comprises a chain drive mechanism which includes a bar upon which said treadle plate is longitudinally and pivotally mounted beneath the stand, a rigid, rectangular frame connected to the bar upon which said treadle plate is mounted, vertical slides which are spaced apart and parallel in relation to each other, and fixed within said rigid, rectangular frame, a threaded shaft having first and second ends and extending therebetween, vertically, rotatably mounted within said rigid rectangular frame, the first end of said threaded shaft being connected to said rigid rectangular frame, and the second end of said threaded shaft having a toothed gear mounted thereon, a rectangular carriage plate vertically movably attached to said vertical slides and to said threaded shaft within said vertical frame, and rigidly fixed perpendicularly to said bar upon which said treadle plate is longitudinally and pivotally mounted, an elongated housing connected longitudinally to said foot pedal assembly between said foot treadle and said rigid, rectangular frame and having first and second opposed ends, the first end extending into said rigid, rectangular frame at a base thereof and being penetrated by said threaded shaft, the toothed gear mounted on said threaded shaft being completely enclosed within said housing, a continuous chain enclosed entirely within said housing and mounted on the toothed gear of the threaded shaft, a motor positioned at the second end of said elongated housing, said motor having a rotatable motor shaft which penetrates said housing and is attached to said continuous chain, whereby operation of said motor causes rotation of said threaded shaft, resulting in vertical movement of said carriage plate and said bar rigidly fixed thereto.

17. The combination of an adjustable foot pedal assembly and an industrial machine which is supported by a stand having legs in contact with a support surface; said foot pedal assembly comprising a treadle plate rockably mounted on said foot pedal assembly beneath and longitudinally in relation to the stand, for operation of the industrial machine supported by the stand;

means for selective transverse adjustment of said foot pedal assembly in relation to a longitudinal axis of the stand, connected to the legs of the stand, spacedly in relation to the support surface;

means for selective vertical adjustment of said foot pedal assembly, in relation to the support surface, connected to the means for selective transverse adjustment; and means for selective initial angle of tilt adjustment of said treadle plate; wherein said means for selective transverse adjustment of said foot pedal assembly comprises a slide mechanism which comprises a rigid horizontal frame beneath the stand, a slide rod secured within the horizontal frame, spacedly and parallel in relation to the floor, and transversely in relation to the longitudinal axis of the stand, a rigid, flat plate positioned horizontally within the rigid horizontal frame and having a rigid tube fixed to an undersurface thereof, the rigid tube having a bore sized for slidable receipt therein of said slide rod, said rigid, flat plate being connected to said treadle plate for simultaneous movement of said treadle plate as said rigid, flat plate moves transversely in relation to the longitudinal axis of the stand on said slide rod, and means for effecting transverse movement of said rigid, flat plate operatively connected thereto.

18. The combination of claim 17, wherein said means for effecting transverse movement of said rigid flat plate comprises a first pneumatic cylinder having first and second opposed ends, said first end being connected to said rigid, horizontal frame, and said second end being connected to said rigid, horizontal frame, and said second end being connected to said rigid, flat plate on the underside thereof, parallel to said slide rod, so that actuation of said first pneumatic cylinder causes corresponding movement of said rigid, flat plate, an air supply for providing power to said first pneumatic cylinder, and means for automatically operating said air supply to thereby cause selective transverse adjustment of said foot pedal assembly.

19. The combination of claim 17, and further comprising means for automatically locking said slide mechanism to thereby ensure that a preselected transverse position of said foot pedal assembly is maintained during operation of the machine.

20. The combination of claim 19, wherein said means for automatically locking said slide mechanism is pneumatically controlled.

21. The combination of claim 20, wherein said pneumatically controlled means for automatically locking said slide mechanism comprises a rigid bar having a series of spaced apart apertures formed therein, said rigid bar being fixed transversely within said rigid horizontal frame, parallel to said slide rod, and a second pneumatic cylinder vertically attached to an upper surface of said rigid, flat plate, said rigid flat plate defining an aperture therein in alignment with which said second pneumatic cylinder is attached and through which a rod within said second pneumatic cylinder can be selectively projected, the aperture in said rigid flat plate passing consecutively over the series of spaced apart apertures formed in said rigid bar, to cause said second pneumatic cylinder to engage a particular one of said series of spaced apart apertures when selective transverse adjustment of said foot pedal assembly is complete, said second pneumatic cylinder also being disengageable to unlock said pneumatic slide mechanism when it is desired to transversely readjust said foot pedal assembly.

22. The combination of an adjustable foot pedal assembly and an industrial machine which is supported by a stand having legs in contact with a support surface; said foot pedal assembly comprising a treadle plate rockably mounted on said foot pedal assembly beneath and longitudinally in relation to the stand, for operation of the industrial machine supported by the stand;

means for selective transverse adjustment of said foot pedal assembly in relation to a longitudinal axis of the stand, connected to the legs of the stand, spacedly in relation to the support surface;

means for selective vertical adjustment of said foot pedal assembly, in relation to the support surface, connected to the means for selective transverse adjustment; and means for selective initial angle of tilt adjustment of said treadle plate, wherein said means for selective initial angle of tilt adjustment of said treadle plate rockably mounted on said foot pedal assembly comprises a flange fixed transversely and perpendicularly to a bottom surface of a said treadle plate and having an arced series of spaced apart apertures formed therein, a fluid cylinder fixed longitudinally to the underside of said treadle plate perpendicularly in relation to said flange, and spacedly from and directed toward said arced series of spaced apart apertures, and means for selectively activating said fluid cylinder when said treadle plate has been adjusted by pressure from a foot to a preselected initial angle of tilt position, to thereby cause said fluid cylinder to engage a coaligned one of said spaced apart apertures, locking said foot treadle in the preselected position.

* * * * *